US007445157B2

(12) United States Patent
Clegg et al.

(10) Patent No.: US 7,445,157 B2
(45) Date of Patent: Nov. 4, 2008

(54) MODEL-HOLD STORED VALUE CARD

(75) Inventors: Timothy Clegg, Manhattan Beach, CA (US); John Dwyer, Oak Pack Hts., MN (US)

(73) Assignee: Americhip, Inc., Torrance, CA (US)

( * ) Notice: Subject to any disclaimer, the term of this patent is extended or adjusted under 35 U.S.C. 154(b) by 0 days.

(21) Appl. No.: 11/698,730

(22) Filed: Jan. 26, 2007

(65) Prior Publication Data

US 2008/0179396 A1 Jul. 31, 2008

(51) Int. Cl.
*G06K 7/00* (2006.01)

(52) U.S. Cl. ..... 235/486

(58) Field of Classification Search ..... 235/486, 235/487; 206/767; 40/642.02
See application file for complete search history.

(56) References Cited

U.S. PATENT DOCUMENTS 5,959,281 A * 9/1999 Domiteaux ..... 235/454
6,568,532 B1 * 5/2003 Leach ..... 206/457
D497,142 S * 10/2004 Smith ..... D12/415
7,000,842 B2 * 2/2006 Yamaguchi et al. ..... 235/486
2003/0150149 A1 * 8/2003 Quick ..... 40/725
2006/0091149 A1 * 5/2006 Chen ..... 221/248
2006/0124748 A1 * 6/2006 Osborn et al. ..... 235/486
2006/0261170 A1 * 11/2006 Mooney et al. ..... 235/486
2007/0194128 A1 * 8/2007 Coe et al. ..... 235/486
2007/0261989 A1 * 11/2007 Stoles ..... 206/767
2007/0277416 A1 * 12/2007 Fedan ..... 40/642.02

* cited by examiner

*Primary Examiner*—Thien M. Le
*Assistant Examiner*—April A Taylor
(74) *Attorney, Agent, or Firm*—Clement Cheng

(57) ABSTRACT

A stored value card device comprises a scaled down model car having an upper body molded into a promotional object model such as a car in association with car accessory products. The model car may be a still model as well as an animated version with the assistance of an electric motor connected to the wheels and a remote controlled driving circuit installed inside the model. The model body is provided at its lower side a card dock and has a partially flat surface at its side and/or top surfaces to provide the viewers with the card identification as well as other information on the stored data. The card dock has an outer plate formed with a large rectangular opening and four perpendicular sidewalls and an inner plate in a two-tiered structure to form a pair of parallel guide slots between the two plates of the dock.

14 Claims, 5 Drawing Sheets

12
13
11
5
12
4
9
7
10
20
9
18
16
15
5
4
19
17
20
9
5
10
9
14

MODEL-HOLD STORED VALUE CARD

BACKGROUND OF THE INVENTION

A. Field of the Invention

The present invention relates to a stored value card. More particularly, the present invention relates to a value card device that poses as a gift while presenting itself as an easily accessible redemption medium for various point of sale systems. The present invention also applies to a store membership card that allows tracking of the customer activities and discount offers.

B. Discussion of Related Art

Stored value cards commonly referred to as Visa cards, gift cards, credit cards, debit cards or pre-paid cards in the retail market contain manually or electronically retrievable monetary values in them and are used as indirect payment methods between the issuing merchants and the customers in purchasing the merchant products/services. They are great for offering goods and services as gifts where cash exchanges are not preferred over thoughtful presentation of a value card, which also provides a range of freedom for the card holder to choose her or his desired item in the store that the card giver selected.

The values stored may be only a dollar or at any increments set by the issuer and agreed upon by the card customer who initially pays for the card value. So, the indistinctive shape of card may have one of a wide range of money amounts printed or written on an appropriate space of the card itself. Oftentimes, there is no monetary amount printed on the card. For example, the store membership card has no stored monetary value but carries the ongoing potential of getting various discounts when the member shopper present it at the cash register.

Unfortunately, when the stored value has been spent, the cards are normally tossed away because the actual card may have no value. This can be against the gift a givers' wish that their gestures be remembered along with what they gave, in this case the card itself. There have been efforts to provide more expressive stored value cards by individual merchants to promote such card transactions and increase sales. An improvement to the existing cards was to change the package adapted to hold the card in merchandising display at the stores into more attractive designs to transfer between individuals.

An improvement to the gift card suggested by the inventor in Stored Value Card With Light U.S. patent application Ser. No. 11/038,018 is equipped with a light emitting diode, which is push-button activated to emit light combined with printed graphics. The previous improvement was successful in providing a form of electronic amusement through lights and sounds to otherwise flat gift card. The previous improvement had a first primary panel, a secondary primary panel spaced from the first primary panel. The first primary panel defines an account identifier signifying a financial accounting linked to the stored value card. Sidewalls are defined between the first primary panel and the second primary panel. The light circuit is located inside the housing and has a switch. The light extends from the sidewall of the housing and can be illuminated by pushing the push button switch. The message cards are found to work well as contemplated. In order to contain the electronic parts, that card device came to have a modified thickness of more than ¼" compared to normal 0.30 mil of card as accepted by most magnetic card reading machines.

Therefore, the retrieval of stored value information was limited to a reading means of a bar code system. That is, the card has a bar code printed on it and scanned at the time of redemption by a cashier only with a barcode scanner. The equally important magnetic swipe readers in the stores could not access such card information due to the oversize sidewall dimension. It is, therefore, necessary to improve the card device to work with both point of sale or POS systems so that the value card devices can be adapted to almost all of the current POS systems that work with smart chip cards and magnetic swipe cards.

Being an electronic card device, the lighted stored value card has to be operated by the card owner to experience the amusing effect and added value. In its design, the card device is purely functional in a box shape offering little room for a visual appeal besides applying a custom graphics printed on the card surface, which is two-dimensional.

Therefore, it is desirable to provide a working card device that is also a three-dimensional model with aesthetic value even if it is not loaded with stored value or purchase power. Such a card preferably lends itself to conventional card transaction systems whether account access is carried out through an optical bar code scanning or magnetic reading through a scanner slot.

It is therefore an object of the present invention to provide a 3-D model with an integral stored value card in an aesthetically and functionally improved combination.

Embodiments of the invention will now be described by way of example with reference to the accompanying drawings.

SUMMARY OF THE INVENTION

A card device according to an embodiment of the present invention is combined with a scaled down model car having an upper body molded into an automobile shape having four wheels. The model car may have an electric motor connected to the wheels and a remote controlled driving circuit inside well known in the toy industry.

The variety of actual models to hold the stored value card of the present invention spans from the form of any natural creatures such as a mineral, fruit or animal to man-made objects like a concept vehicle, robot or a landmark building as long as it promotes a positive spirit around gift giving and consumer spending for certain merchandise or service. Also, the model itself may be a functional housing such as a business card or cigar case and/or a carrier for a pen and note or a multi-purpose tool set. It may also be a pill container and/or a compact containing a mirror and perfume or a set of sample products to encourage the card recipient to buy the full product using the very card in the model. Generally speaking, many promotional products for advertising a business are readily adaptable to make promotional cardholders through the present invention.

The model body is provided at its lower side a card dock and has a partially flat surface at its side and/or top surfaces to provide the viewers with the card identification as well as other information on the stored data. The card dock has an outer plate formed with a large rectangular opening and four perpendicular side walls and an inner plate in a two-tiered structure to form a pair of parallel guide slots between the two plates of the dock.

A slide-out card is installed in the guide slots of the card dock. The card comprises a planar body, which has two opposite longer sides and two opposite shorter sides as well as a lower surface and an upper surface. The lower surface has a magnetic stripe or bar code of a financial data extending along one of the longer sides and a pair of tabs extending from the shorter sides of the card body opposite to the magnetic stripe or bar code.

Thus, the tabs of the card body are received in the guide slots of the dock so that the magnetic stripe or bar code is slidingly exposed by a push of a finger to facilitate machine reading of the financial data.

The model and dock may be made of plastics through injection molding. Also, the dock may be made of hard plastics while the model is of an elastic material like rubber among others. In another embodiment, the model may be a stuffed toy whereas the plastic dock is located at a less visible side of the toy.

When the present invention is implemented through a container model that needs opening and closing between the model and the dock, an appropriate means for hinging and latching may be added.

The card dock is dimensioned similar to typical credit cards with an increased thickness while the card itself may be a typical stock card adapted to have two opposite cutouts defining the tabs to be lodged in the guide slots of the card dock.

The dock has a rectangular opening surrounded at three sides by an outer plate of the dock leaving a lateral opening through which the card slides on the inside surface of the outer plate. The rectangular inner plate is positioned inside of the outer plate of the dock to cover at least the rectangular opening. The inner plate is generally flat except that it is slightly raised at a longer edge for limiting the innermost sliding movement of the card and two opposite short protrusions near the lateral opening for stopping the card's outermost sliding movement.

With the inner plate positioned between the model and the dock, they are fastened together by screws at the four corners of the dock although a chemical adhesive, or sonic, or heat welding may be applied instead.

The opposing protrusions are distanced so that once the card is seated on the inner plate of the dock it normally maintains sliding abutments with the inner edges of the opposing protrusions in a tight fit. Thus, the card will slide only with a finger push by the user.

Optionally, the inner plate of the dock may support an electronic device on a printed circuit board for mobilizing the model car at its first side. If a sound/visual effect is desired for an enhanced amusement for the card device, it may incorporate a light circuit including a light, a speaker and a switch supported on the second side of the inner plate of the dock or other interior location of the model so that the light circuit is generally enclosed within the model but for the light and the light extends from the model for illumination upon application of a force to the switch. The light circuit may have an internal light fully maintained within the model holder, and the illumination of the internal light can be made visible through a light permeable portion of the model holder.

To make a secure fastening with the card dock, the model has screw posts at its four bottom corners to which the corresponding holes of the card dock register. The screw posts protrude toward the holes of the dock to receive the screws therein. In addition, the model may have four perpendicular sidewalls, the first two of which extend in parallel partially along the bottom edges of the model as the other two sidewalls span the width of the model connecting the opposite ends of the first two sidewalls. But the widthwise sidewalls are interrupted by an open interior of the model. Such broken sidewalls may be covered by extensions of the bottom plate of the card dock that can be designed in conformity with the different shapes of the model bottom. In addition, the sidewalls of the model have stepped end surfaces for engaging with the opposing sidewall surfaces of the card dock.

The inner and outer plates of the card dock may be formed in a single piece connected by sprues to facilitate the assembly of the card device. When the model and the card dock are fastened together, the card body may be flexed at its tabs and inserted in the slots to complete the model-hold card device.

BRIEF DESCRIPTION OF THE DRAWINGS

Similar reference numbers denote corresponding features throughout the attached drawings.

DETAILED DESCRIPTION OF THE PREFERRED EMBODIMENT

Figure 1:
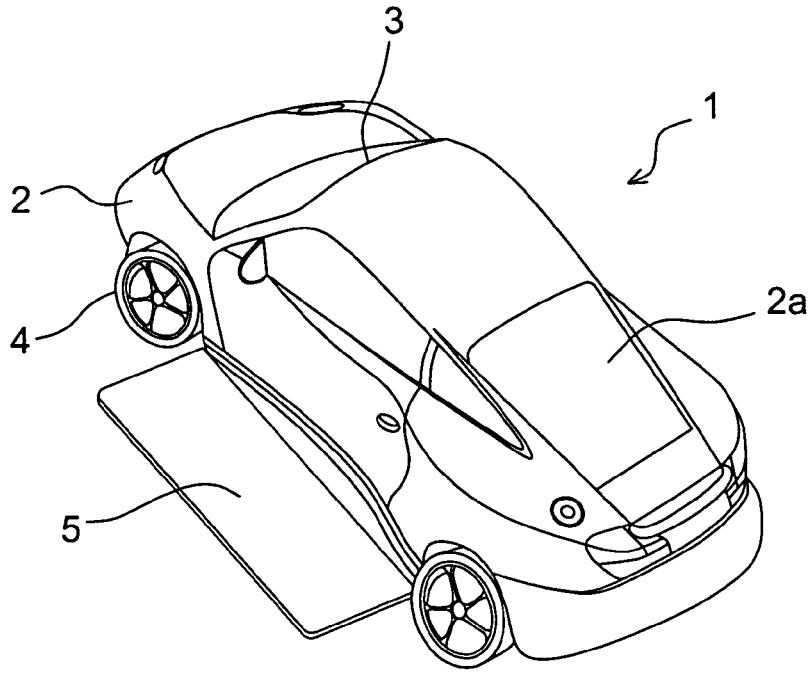
FIG. 1 is a perspective view of the combination model car-card device according to an embodiment of the present invention.
Figure 2:
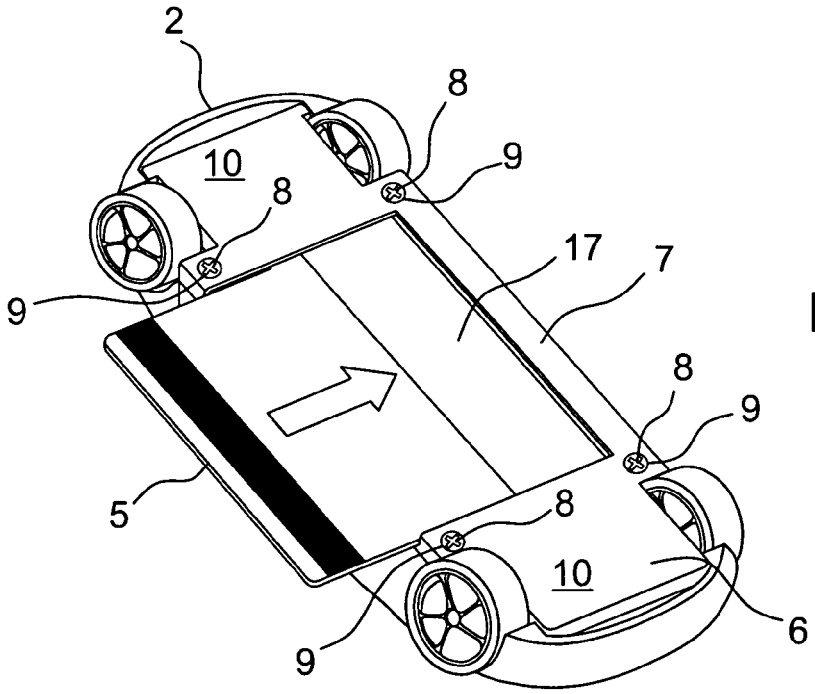
FIG. 2 is a perspective view of the bottom of the card device of FIG. 1.

With reference to FIG. 1 and FIG. 2, a card device 1 according to an embodiment of the present invention is combined with a scaled down model car having an upper body 2 molded into an automobile shape with contour lines 3 to depict doors, hood, wind shield, bumpers and other typical characteristics of a car. The model body 2 is provided at its side and/or top surfaces a partially flat surface 2*a* to provide the viewers with the card identification as well as other information on the stored data. Four wheels 4 may be rotationally mounted under the body 2. The model car may have an electric motor connected to the wheels 4 and a remote controlled driving circuit inside well known in the toy industry.

The actual model to hold the stored value card of the present invention is not limited but preferably varies from the form of any natural creatures such as a mineral, fruit or animal to man-made objects like a concept vehicle, robot or a landmark building as long as it promotes a positive spirit around gift giving and consumer spending for certain merchandise or service. Also, the model itself may be a functional housing such as a business card or cigar case and/or a carrier for a pen and note or a multi-purpose tool set. It may also be a pill container and/or a compact containing a mirror and perfume or a set of sample products to encourage the card recipient to buy the full product using the very card in the model. Generally speaking, many promotional products for advertising a business are readily adaptable to make the promotional cardholders through the present invention.

At the bottom area of the car model of the present card device 1 a slide-out card 5 is installed. FIG. 2 clearly reveals the bottom where a lower chassis 6 of the car 2 comprises a card dock 7 for guiding the card 5 to slide between its deployed position as in FIG. 2 and a fully contained position in the dock 7 at the push of a finger.

The area of the card dock 7 is rectangular as defined by four corners where screws 8 are driven through holes 9 of the dock 7 into the model 2. Extended areas 10 are for the sake of the specific design of the lower chassis 6 that can be varied depending on the different model to which the card dock 7 integrates.

The model 2 and dock 7 join together through a simple complementary engagement as will be described later in more detail. The model 2 and dock 7 may be made of plastics through injection molding. Also, the dock 7 may be made of hard plastics while the model 2 is of an elastic material among others. The model 2 may be a stuffed toy whereas the plastic dock 7 is located at a less visible side of the toy.

When the present invention is implemented through a container model that needs opening and closing between the model and the dock 7, an appropriate means for hinging and latching may be added.

Figure 3:
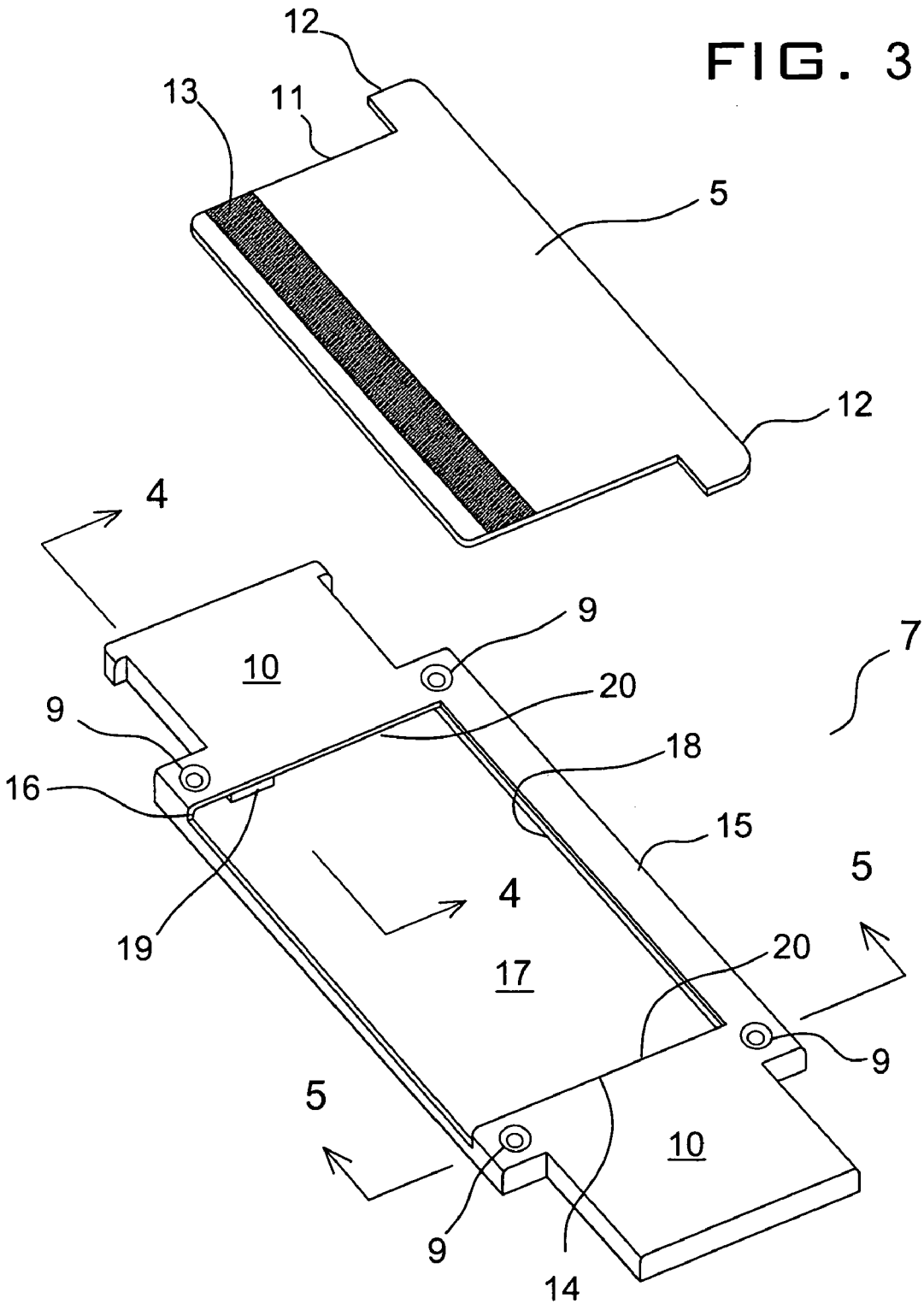
FIG. 3 is an exploded perspective view of a card component and housing before they are assembled as shown in FIG. 2.

The card dock 7 is dimensioned similar to typical credit cards in that it has an area of 3⅜" length×2⅛" width except its thickness of about ⅛" while the card 5 itself may be a typical stock card adapted to have two opposite cut-outs 11 leaving a couple of tabs 12 at the top corners, which will be lodged in the dock 7 at manufacturing as shown in FIG. 3. The card dock 7 has a two-tired structure for mounting the card 5. The card 5 may have a magnetic stripe 13 as well as a bar code not shown, which contains financial data including the value stored for the card at an edge away from the tabs 12.

The dock 7 has a rectangular opening 14 surrounded at three sides by an outer plate 15 of the dock 7 leaving a lateral opening 16 through which the card 5 slides on the inside surface of the outer plate 15. A rectangular inner plate 17 is positioned at the inside of the outer plate 15 of the dock 7 to cover at least the rectangular opening 14. The inner plate 17 is generally flat except that it is slightly raised at a longer edge 18 for limiting the innermost sliding movement of the card 5 and two opposite short protrusions 19 near the lateral opening 16 for stopping the card's outermost sliding movement.

With the inner plate 17 positioned between the model 2 and the dock 7, they are fastened together by screws 8 at the four corners of the dock 7 as shown in FIG. 2. Alternatively, a chemical adhesive or heat welding may bond the model 2 and dock 3.

Thus, the card 5 is adapted to slide in two opposite guide slots 20 collectively formed by the outer plate 15 and the inner plate 17 and limited by the edge 18 and the short protrusions 19.

Figure 4:
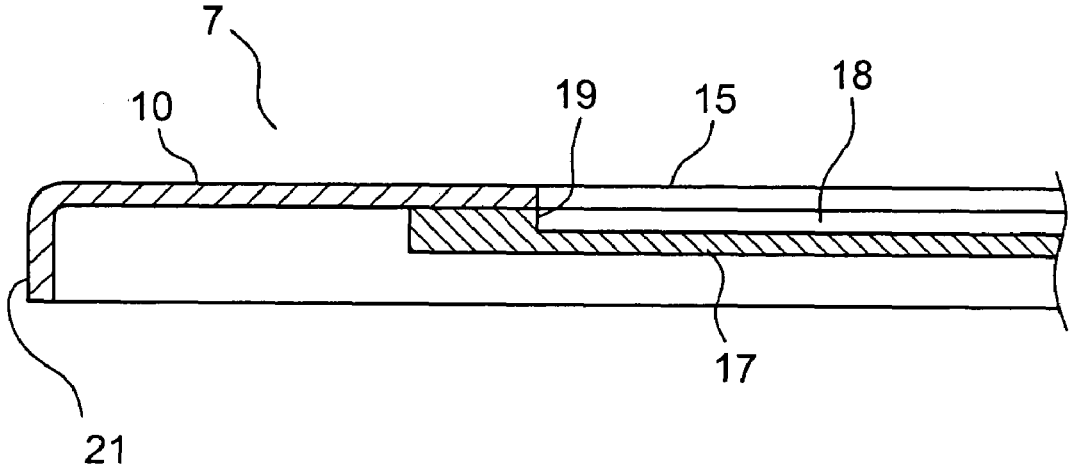
FIG. 4 is a sectional view as seen along the line 4-4 of FIG. 3.
Figure 5:
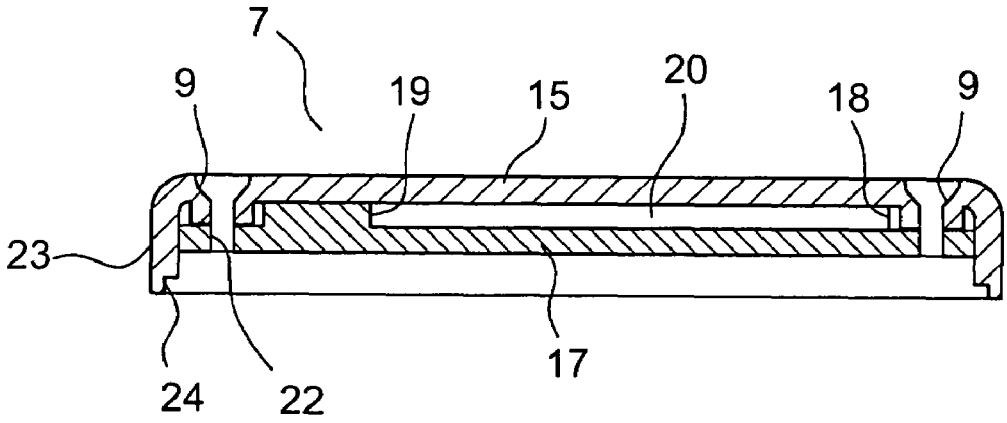
FIG. 5 is a sectional view as seen along the line 5-5 of FIG. 3.

FIGS. 4 and 5 clearly show such positional relations of the components of the card dock 7 in cross sectional views. FIG. 4 is a partial sectional view seen in a direction of travel of the card 5 perpendicular to the longitudinal axis of the card dock 7. The extension 10 of the outer plate 15 is terminated by perpendicular sidewalls 21. The raised edge 18 and protrusion 19 of the inner plate 17 abut the lower surfaces of the outer plate 15 to maintain the guide slot 20 shown in FIG. 5 seen across the dock 7 along its longitudinal axis. The inner plate 17 also has at its four corners screw holes 22 communicating with the holes 9 of the outer plate 15 for threading together by the screws.

Along the length of the longer sides of the card dock 7 and at least parts of its shorter sides, the outer plate 15 extends in sidewalls 23, which are formed with stepped end surfaces 24 for mating with the complementary counterpart at the side of the model 2.

Figure 6:
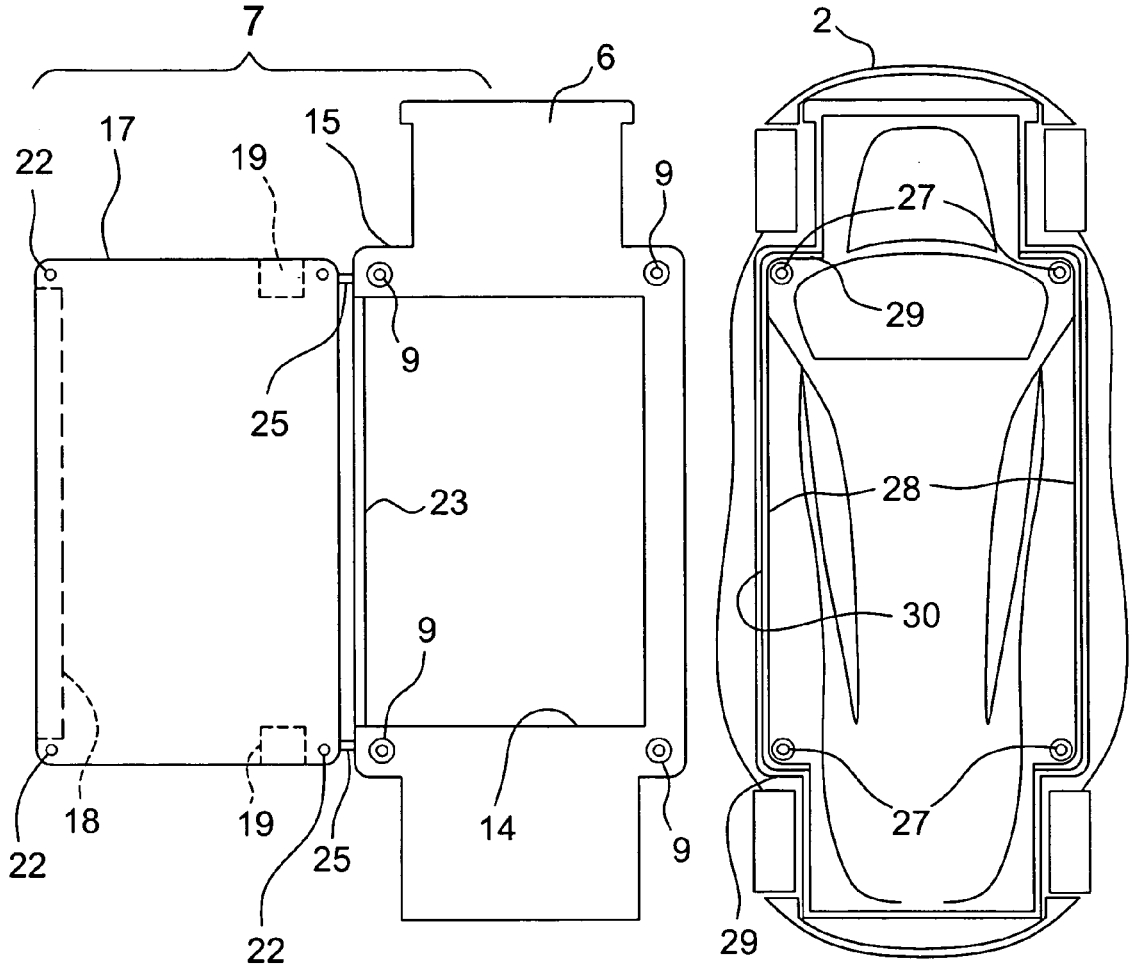
FIG. 6 is an exploded view of the housing and the mating surface of the model car according to the present invention.
Figure 7A:
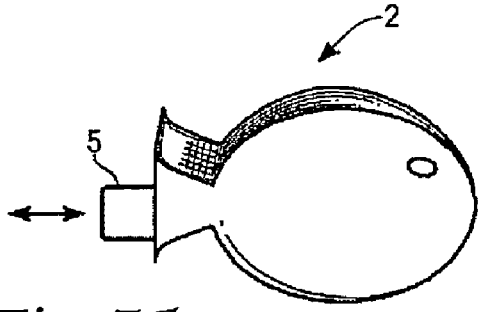
FIG. 7*a* is a fish model with sliding card.
Figure 7B:
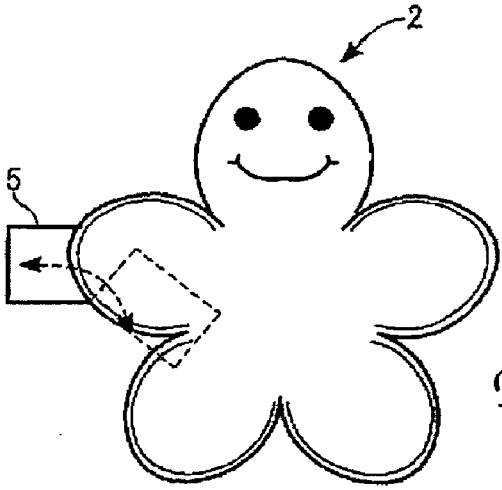
FIG. 7*b* is a plush model with rotating card.
Figure 7C:
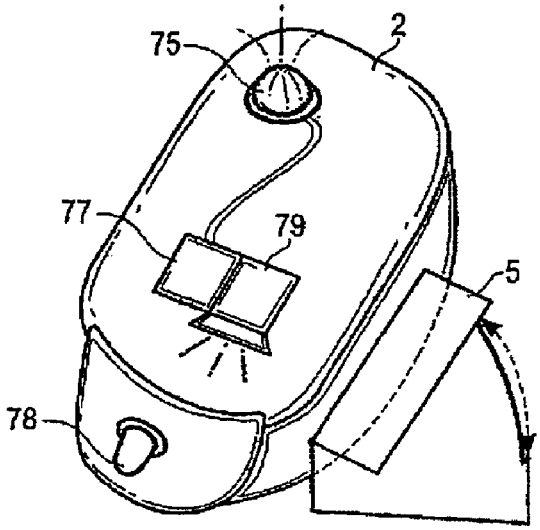
FIG. 7*c* is a model with rotating card.

FIG. 6 shows the bottom view of the model 2 and card dock 7 ready for assembly with the inner plate 17 attached to the outer plate 15 by a pair of sprues 25 connecting the two components since they are formed of a one-piece material.

The opposing protrusions 19 are distanced so that once the card 5 is seated on the inner plate 17 it normally maintains sliding abutments with the inner edges of the opposing protrusions 19 in a tight fit. Thus, the card 5 will slide only with a finger push by the user.

If necessary, the inner plate 17 may support at its interior side an electronic device on a printed circuit board for mobilizing the model car 2. If a sound/visual effect is desired for an enhanced amusement for the card holder, it may include a light circuit including a light, a speaker and a switch, the light circuit being generally enclosed within the holder but for the light, wherein the light extends from the holder and is configured to be illuminated upon application of a force to the switch. The light circuit may have an internal light fully maintained within the holder, and the illumination of the internal light is visible through a light permeable portion of the holder.

To make a secure fastening with the card dock 7, the model 2 has screw posts 27 at its four corners corresponding to the holes 9 of the card dock 7. The screw posts 27 protrude toward the holes 9 of the dock 7 to receive the screws 8 therein. In addition, the model 2 has four perpendicular sidewalls 28 and 29, the first two of which at 28 extend in parallel partially along the bottom edges of the model 2 as the other two 29 span the width of the model 2 connecting the opposite ends of the first two sidewalls 28. But the widthwise sidewalls 29 are interrupted by an open interior of the model 2. In addition, the sidewalls 28 and 29 have stepped end surfaces 30 for engaging with the opposing sidewall surfaces 24 shown in FIG. 5.

With the inner plate 17 folded about the sprues 25 to the interior of the outer plate 15 and snuggly fitted therein the card dock 7 fits over the bottom of the model 2 and they are fastened together. Then, a flex of the card 5 at its tabs 12 and inserting it in the slots 20 will complete the model-hold card device 1 of FIG. 1.

The model card 1 will three-dimensionally reminds the card recipient of the association of the model with the card and the next shopping event, wherein the model with the card slid out can be handed over to a merchant for swiping just as with traditional credit cards or other stored value cards.

Therefore, while the presently preferred form of the model-hold stored value card has been shown and described, and modifications thereof discussed, persons skilled in this art will readily appreciate that various additional changes and modifications may be made without departing from the spirit of the invention, as defined and differentiated by the following claims.

Although the drawings show the card sliding out along a certain side of the card dock, the card can be adapted, and the slots can be adapted to provide a variety of sliding configurations such as sliding out any of the four sides of the card dock, or sliding in a non linear fashion, or sliding in a rotational manner where the card is affixed to the dock at an axis. The slotted connection can be formed in either the model, the card dock or in a combination of the two. The card dock is also called the carrier, because it carries the card as well as the electrical components.

CALL OUT LIST OF ELEMENTS

1: Model Car Card Device
2: Car Body
2*a*: Flat Surface
3: Contour Line
4: Wheel
5: Card
6: Lower Chassis
7: Card Dock
8: Screws

9: Though Holes
10: Extended Area
11: Cut Out
12: Tab
13: Magnetic Stripe
14: Rectangular Opening
15: Outer Plate
16: Lateral Opening
17: Inner Plate
18: Edge
19: Short Protrusion
20: Guide Slot
21: Sidewalls
22: Screw Hole
23: Sidewalls
24: Stepped End Surfaces
25: Sprue
27: Screw Post
28,29: Sidewalls
30: Stepped End Surfaces

The invention claimed is:

1. A model-hold stored value card device comprising:

a housing having an upper section and a lower section fastened to the upper section with an internal space formed between the sections, the upper section being shaped as a three dimensional scaled model of an object for providing positive attractions toward the stored value card device and having a partially flat surface to provide viewers with a card identification and the lower section having an outer plate being formed with an opening and having four perpendicular side walls and an inner plate to form a pair of parallel guide slots between the two plates of the lower section; and a planar card body having two opposite longer sides and two opposite shorter sides as well as a lower surface and an upper surface, the lower surface having a magnetic stripe or bar code of a financial data so that the magnetic stripe or bar code is slidingly exposed to facilitate a machine reading of the financial data.

2. The model-hold stored value card device of claim 1, wherein the model hold stored value card device is a scale car having four wheels.

3. The model-hold stored value card device of claim 1, wherein the model-hold stored value card device is in the form of an animal or a vehicle.

4. The model-hold stored value card device of claim 1, wherein the upper and lower sections of the housing are made of plastic material by injection molding and the sections are fastened together by screws.

5. The model-hold stored value card device of claim 1, wherein the upper section is made of an elastic material and the lower section of the housing is made of plastic material by injection molding and the sections are fastened together by heat or chemical bonding.

6. The model-hold stored value card device of claim 1, wherein the upper section is a stuffed toy and the lower section of the housing is a card dock or carrier made of plastic located at a less visible side of the toy.

7. The model-hold stored value card device of claim 1, wherein the planar card body is a credit card, which allows recurring credit transactions.

8. The model-hold stored value card device of claim 1, wherein the planar card body is a gift card presented by a card purchaser who pays to load a stored value to a recipient who redeems the value card in payment of products and/or services associated with a card issuer.

9. The model-hold stored value card device of claim 1, wherein the planar card body is a store membership card that allows tracking of a customer activities in exchange of discount offers.

10. A model-hold stored value card device comprising:

an upper section forming the upper portion of a housing;

a lower section forming the lower portion of the housing, wherein the lower section is bonded to the upper section with an internal hollow space formed between the sections, wherein the upper section is shaped as a three dimensional scale model of an object for promoting the stored value card device, wherein the lower section includes an outer plate being formed with an opening and having four side walls; and wherein the lower section includes an inner plate to form a pair of guide slots between the two plates of the lower section; and a planar card body having two opposite longer sides and two opposite shorter sides as well as a lower surface and an upper surface; and a magnetic stripe or bar code on the card that is selectively exposed to facilitate a machine reading of the financial data in an exposed configuration and retracted in a retracted configuration.

11. The stored value card device of claim 10, further comprising a light circuit including a light and a switch, the light circuit being generally enclosed within the housing but for the light, wherein the light extends from the housing and is configured to be illuminated upon application of a force to the switch.

12. The stored value card device of claim 10 further comprising a light circuit including a light and a switch.

13. The stored value card device of claim 10, further comprising a light circuit including an internal light fully maintained within the housing, and the illumination of the internal light is visible through a light permeable portion of the housing.

14. The stored value card device of claim 10, wherein the slot is curved and provides a rotational sliding path wherein the card is affixed to the carrier at an axis of rotation, further comprising a light circuit wherein the light circuit includes an internal light fully maintained within the housing, and the illumination of the internal light is visible through a light permeable portion of the housing, further comprising a light circuit including a light and a switch, the light circuit being generally enclosed within the housing but for the light, wherein the light extends from the side of the housing and is configured to be illuminated upon application of a force to the switch.

* * * * *

UNITED STATES PATENT AND TRADEMARK OFFICE
Certificate

Patent No. 7,445,157 B2 Patented: November 4, 2008

On petition requesting issuance of a certificate for correction of inventorship pursuant to 35 U.S.C. 256, it has been found that the above identified Patent, through error and without any deceptive intent, improperly sets forth the inventorship.

Accordingly, it is hereby certified that the correct inventorship of this Patent is: Timothy Clegg, Manhattan Beach, CA (US); John Dwyer, Oak Pack Hts., MN (US); Ted C. Halbur, Lino Lakes, MN (US); Travis M. Robertson, Minnetonka, MN (US); David B. Smith, Falcon Heights, MN (US); Erin M. Wood, Andover, MN (US); and Primoz Samardzija, Marina del Ray, CA (US).

Signed and Sealed this Twenty-fourth Day of July 2012.

STEVEN S. PAIK
*Supervisory Patent Examiner*
Art Unit 2887
Technology Center 2800